US006119362A

United States Patent [19]

Sundqvist

[11] Patent Number: 6,119,362

[45] Date of Patent: Sep. 19, 2000

[54] ARRANGEMENTS FOR IMPINGEMENT DRYING AND/OR THROUGH-DRYING OF A PAPER OR MATERIAL WEB

[75] Inventor: Hans Sundqvist, Turku, Finland

[73] Assignee: Valmet Corporation, Finland

[21] Appl. No.: 09/206,482

[22] Filed: Dec. 7, 1998

Related U.S. Application Data

[63] Continuation-in-part of application No. 08/878,547, Jun. 19, 1997, Pat. No. 5,845,415.

[30] Foreign Application Priority Data

Jun. 19, 1996 [FI] Finland ..... 962551

[51] Int. Cl.[7] ..... D06F 58/00

[52] U.S. Cl. ..... 34/120; 34/122; 34/124; 34/634

[58] Field of Search ..... 34/116, 117, 119, 34/120, 122, 124, 125, 634, 635, 638, 643, 649; 162/205, 206, 207, 359.1; 239/103, 104, 105, 106

[56] References Cited

U.S. PATENT DOCUMENTS

| | | | |
|---|---|---|---|
| 3,447,247 | 6/1969 | Daane | 34/634 X |
| 3,763,571 | 10/1973 | Vits | 34/57 A |
| 3,982,328 | 9/1976 | Gustafsson et al. | 34/156 |
| 4,361,466 | 11/1982 | Wong et al. | 162/207 |
| 4,462,868 | 7/1984 | Oubridge et al. | 34/115 X |
| 4,551,203 | 11/1985 | Eskelinen | 162/202 |
| 5,070,627 | 12/1991 | Zagar | 34/156 |
| 5,105,558 | 4/1992 | Curry | 34/449 |
| 5,210,958 | 5/1993 | Bond et al. | 34/18 |
| 5,383,288 | 1/1995 | Ilmarinen | 34/124 X |
| 5,471,766 | 12/1995 | Heikkkilä et al. | 34/461 |
| 5,477,624 | 12/1995 | Haessner et al. | 34/117 |
| 5,495,678 | 3/1996 | Ilmarinen et al. | 34/117 |
| 5,509,215 | 4/1996 | Koirmanen et al. | 34/120 X |
| 5,515,619 | 5/1996 | Kahl et al. | 34/117 |
| 5,557,863 | 9/1996 | Kokkala et al. | 34/117 X |
| 5,588,223 | 12/1996 | Marshall | 34/414 |
| 5,689,897 | 11/1997 | Schiel | 34/122 X |
| 5,782,009 | 7/1998 | Kotitschke | 34/114 X |
| 5,860,223 | 1/1999 | Kahl | 34/120 X |
| 5,865,955 | 2/1999 | Ilvespaa et al. | 34/123 X |
| 5,879,515 | 3/1999 | Straub et al. | 162/275 |
| 5,987,777 | 11/1999 | Goebel et al. | 34/120 X |

FOREIGN PATENT DOCUMENTS

| | | |
|---|---|---|
| 0561256 | 9/1993 | European Pat. Off. . |
| 55881 | 11/1975 | Finland . |
| 2020430 | 12/1971 | Germany . |

*Primary Examiner*—Stephen Gravini
*Attorney, Agent, or Firm*—Steinberg & Raskin, P.C.

[57] ABSTRACT

An arrangement for impingement drying and/or through-drying of a paper or material web in which the web is dried by blowing hot air and/or superheated steam from an impingement drying and/or through-drying dryer in a direction substantially perpendicular to the web, and the web runs on support of a wire or equivalent past the dryer. In the area of the dryer, the web and wire are supported from the opposite side of the wire, opposite in relation to the web, by blowings produced from one or more vacuum blow boxes substantially across the entire width of the web. The outlet direction of the blowings may be substantially the same as the running direction of the drying wire and as such, steam and/or air is/are ejected out of the space between the drying wire and the wall placed in connection with the blow boxes that produce the blowings. A second set of blowings from the blow boxes may be blown in the direction opposite to the running direction of the wire so as to seal the area of vacuum between the wire and the blow box. Also, the blowings may be arranged to reduce the pressure in a gap formed at an edge of the blow box and thereby maintain the web on the wire.

23 Claims, 2 Drawing Sheets

ARRANGEMENTS FOR IMPINGEMENT DRYING AND/OR THROUGH-DRYING OF A PAPER OR MATERIAL WEB

CROSS-REFERENCE TO RELATED APPLICATION

This application is a continuation-in-part of U.S. patent application Ser. No. 08/878,547 filed Jun. 19, 1997 now U.S. Pat. No. 5,845,415.

FIELD OF THE INVENTION

The present invention relates to an arrangement for impingement drying and/or through-drying of a paper web or an equivalent web-like material which comprises an impingement drying and/or through-drying device(s) whereby the web to be dried is arranged to run on support of a wire or equivalent past the drying device(s).

The present invention also relates to a device in connection with a planar draw of a paper web or an equivalent web-like material which is arranged in connection with an impingement drying and/or through-drying dryer. The paper web runs past the impingement-drying and/or through-drying dryer on support of a wire or equivalent supporting substrate. The device includes blow nozzles which produce a vacuum effect so as to support the running of the web substantially across the entire width of the web.

BACKGROUND OF THE INVENTION

As known in the prior art, the use of superheated steam as the drying medium is more advantageous than the use of hot air, because in such a case it is also possible to utilize the hot moisture separated from the web. When paper is dried by means of superheated steam, it is known in the prior art to use devices in which the paper web runs on support of a wire and in which, at the side of the paper web, an impingement dryer is placed which includes blow openings for steam and exhaust openings for the return steam. The area of the impingement dryer has been formed as a closed space by means of an enclosure such as a hood. Inside the enclosure, there can also be several separate dryers. The closed space in the interior of the enclosure is usually filled with steam whose temperature is somewhat higher than 100° C. Compared with conventional impingement drying processes provided with an impingement drying hood, an advantage of an enclosed arrangement is that the number of potential leakage points is minimized to two, i.e., the point at which the paper web is passed into an interior of the enclosure and the point at which the paper web is passed out of the interior of the enclosure.

The prior art constructions involve, among other things, the drawback that, with such an enclosure, there should not occur any web breaks or equivalent in the interior of the enclosure, because entering into the interior of the enclosure for repair and/or maintenance operations requires a time-consuming process of emptying the interior of steam and a period of cooling of the equipment and, after the maintenance or cleaning, a long start-up period, during which period the air must be removed and the equipment is heated to the operational temperature, which in itself lowers the capacity of the equipment and causes undue expenses.

In the prior art constructions, the paper web often runs on support of a wire, and the web is kept in contact with the wire by means of a difference in pressure across the wire. The drying air jets of the impingement drying are in themselves insufficient for producing this difference in pressure because the process between the nozzle face and the paper is somewhat dynamic, in which connection the paper web can be separated from the wire.

In the prior art, mechanical seals have been suggested as a solution, which seals permit the maintaining of a certain difference in pressure between the top and bottom portions of the enclosure. However, mechanical seals are not favorable because they drag against the wire and thus wear the wire. Further, the use of mechanical seals has the consequence that the difference in pressure must be maintained over the length of the entire enclosure from the inlet opening of the paper to the outlet opening, because cross-direction additional seals for maintaining a difference in pressure make the equipment considerably more complex. For this reason, at the inlet and outlet openings of the enclosure, there is a pressure above the wire and/or a vacuum below the wire. However, this can result in leakage of steam out of the enclosure above the wire or in flow of air into the enclosure below the wire at the openings if the sealing arrangement of the openings for the web is not fully sealed.

Further, alignment of a mechanical seal is difficult, because the seal must coincide with the edge of the paper web with adequate precision, which is very difficult to accomplish under production conditions. If leakage occurs through the wire outside the edges of the paper web, the result is a reduced difference in pressure or a steam flow from the top side to the bottom side.

Besides sealing, further important factors in applications of impingement drying of a paper web or an equivalent web-like material, from the point of view of runnability, include the keeping or maintenance of the web substantially straight and the constant distance of the web from the blow devices. In order to control the running of the web, it is known to use a suction box placed underneath the wire, but the faces of the suction box that drag against the wire as well as the exhaust suction produced by the suction box cause problems for the runnability of the web and affect its stability on the face of the wire.

With respect to prior art related to the present invention, reference is made to the current assignee's Finnish Patent No. 67,107 (corresponding to U.S. Pat. No. 4,551,203) which describes an arrangement for passing a paper web from the press section into the dryer section, in which, to the side of the drying wire that supports the web, a number of air jets are blown at a speed substantially higher than the speed of the drying wire. The outlet direction of these jets is substantially the same as the running direction of the drying wire at that location, and air is ejected by means of this blowing of air out of the space placed between the drying wire and the wall placed in connection with the members that produce the air jets. In this arrangement, blow boxes are employed, which are positioned on the run of the drying wire at the side of the wire, which extend substantially across the entire width of the web and include one or more nozzle slots. In the blow boxes, the walls placed facing the run of the drying wire are plane (flat) and substantially parallel to the run of the drying wire.

It is known in the prior art to use various impingement-drying/through-drying units for evaporation drying of a paper web. In these units, the paper web is dried so that, by means of the impingement drying devices, hot air or superheated steam is blown in a direction substantially perpendicular to the paper at a relatively high speed. In these constructions, the paper web or equivalent web-like material often runs on support of a wire, roll, cylinder or equivalent support member. With respect to the prior art constructions related to evaporation drying of a paper web and based on impingement drying, reference is made to U.S. Pat. No. 4,361,466, which describes a web drying method and apparatus that employ hot air, and to U.S. Pat. No. 5,210,958, which describes an apparatus and method for drying a paper web in which superheated steam is employed.

Reference is also made to Finnish Patent Application No. 971713 (corresponding to International Application No. PCT/FI 98/00350) which describes a dryer section in which the first drying unit is a planar drying unit including a blow hood under which the web to be dried runs horizontally in a plane supported by a wire. The planar, horizontal run of the wire is enabled by appropriate positioning of grooved rolls and/or suction or blow boxes.

OBJECTS AND SUMMARY OF THE INVENTION

An object of the present invention is to provide a construction by whose means, in impingement drying, in particular in an arrangement in which the drying medium is superheated steam, the runnability of the web is satisfactory.

It is a further object of the invention to provide a construction in which the problems and drawbacks described above in connection with prior art web drying constructions do not occur.

It is another object of the present invention to provide a new and improved device for impingement drying and/or through-drying of a paper or material web.

Another object of the present invention is to provide a construction for a blow box suitable for use in connection with a planar dryer provided with impingement-drying/through-drying in order to support the run of the web and the wire.

In view of achieving at least some of the objects stated above and others, in some embodiments of the invention, the arrangement comprises at least one vacuum blow box for supporting the web and the wire by means of blowings produced by means of the vacuum blow box(es) substantially across the entire width of the web. The blow medium in the vacuum blow box(es) is substantially the same medium as the blow medium in the impingement drying/through-drying unit/units.

One or more vacuum blow boxes may be arranged at the opposite side of the paper web or an equivalent web-like material and the wire, opposite in relation to the impingement dryer, i.e., blow devices by whose means a vacuum is produced below the wire (the web being supported above the wire). These vacuum blow devices generate the necessary difference in pressure across the wire, in which connection the paper web remains in contact with the wire and the runnability thereof is secured.

In some embodiments of the present invention, it has been realized, in a novel manner with a view toward securing the runnability of a web, to combine an impingement drying application with vacuum blow boxes, by whose means the keeping and maintaining of the web on the wire is secured and by whose means, at the same time, the desired distance of the web from the impingement drying devices and the control of this distance can be achieved, in which connection the efficiency of evaporation can also be controlled. In this manner, by means of the arrangement in accordance with the invention, the desired draw of the paper web through the enclosure in the impingement drying unit is achieved.

By means of certain arrangements in accordance with the invention, a sealing arrangement free of contact is achieved, in which there are no faces that drag against the wire or against the paper web. The blower in the system of runnability in accordance with the invention can also be used for emptying the enclosure from steam in a running-down situation, for example, for maintenance, and for evacuating air during a start-up procedure without having to use separate devices.

When the web is dried by means of superheated steam, steam is preferably used as the blow medium in the vacuum blow devices, which steam is preferably taken from the interior of the enclosure, primarily from below the wire (on the side of the wire on which the blow devices are situated) in order that disturbing flows should not arise in the vertical direction in the enclosure. If necessary, in the steam supply line for the blow boxes there is a heating device, for example a steam heat exchanger or a direct supply of fresh steam, so as to maintain a suitable temperature level and thus, to eliminate any risk of condensation of the steam. In connection with the arrangement in accordance with the invention, it is also preferable to apply a system of control of runnability and steam status, wherein, by means of a blower, steam is also sucked from above the paper web and the wire and the same amount of steam is fed back to this area above the web after it has been heated. In order to maintain the temperature level in the enclosure, the heating device provided in the system of runnability is probably adequate, and no other heating or supply of steam into the enclosure is needed.

Another embodiment of an arrangement in accordance with the present invention comprises a blow box in which there is at least one blow nozzle which produces a blowing in a gap formed in connection with a planar draw of a web so as to produce a vacuum effect.

In accordance with this embodiment of the invention, in the planar draw, a blow box is employed, which has been arranged between support rolls, and which blow box comprises one or more blow nozzles operative to direct medium in order to reduce the pressure in the gap and preferably produce a vacuum effect in the gap. Further, the blow box preferably comprises lateral blow nozzles which produce lateral sealing, as described, e.g., in U.S. Pat. No. 4,628,618, incorporated by reference herein.

Blow boxes in accordance with the present invention may be arranged between the support rolls, and it is possible to use either identical boxes one after the other, or so that, when two boxes are placed side by side between support rolls, the blow nozzles of the boxes are placed at opposite sides, in which case their blowings are directed at the same gap. Of course, in connection with the arrangement in accordance with the invention, it is also possible to employ blow boxes, in which case, their blowings are directed from both ends.

An arrangement in accordance with the invention in connection with a planar draw of a paper web or an equivalent web-like material is used preferably in connection with impingement drying or through-drying when an impingement-drying or through-drying dryer is concerned which is substantially planar, in which case the web runs under the dryer on support of a wire in a substantially horizontal run. Such a planar dryer may be placed either in the beginning of the dryer section, as is described, e.g., in International Application No. WO 98/48106, or between groups of cylinders.

In the following, the invention will be described in more detail with reference to the figures in the accompanying drawings. However, the invention is not strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
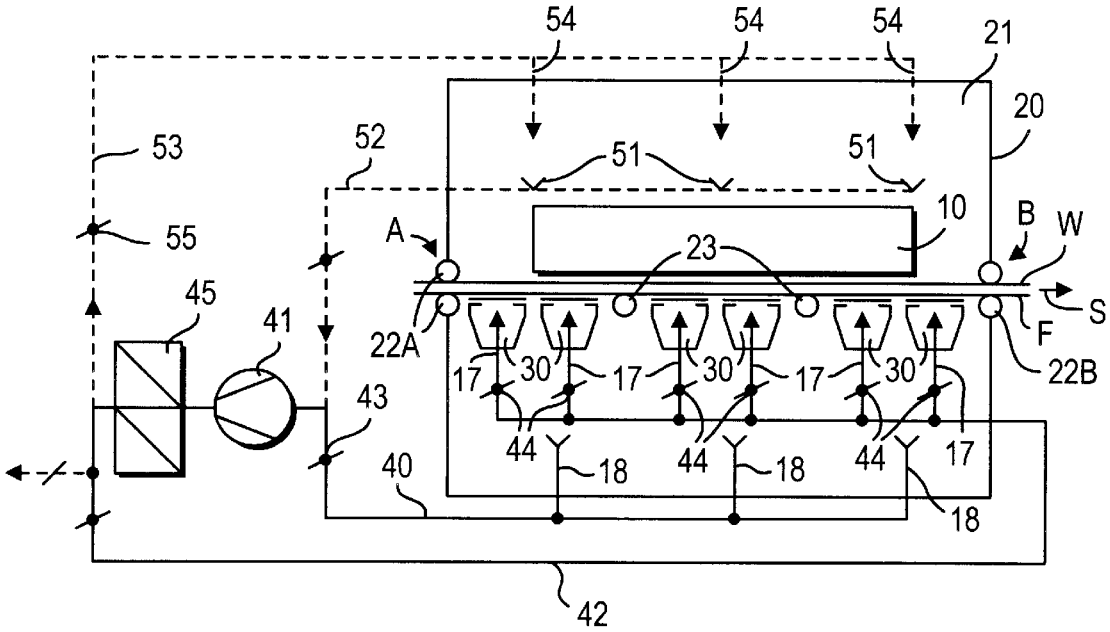
FIG. 1 is a schematic illustration of an arrangement of runnability in accordance with the invention in connection with impingement drying and in which the method in accordance with the invention may be applied.
Figure 2:
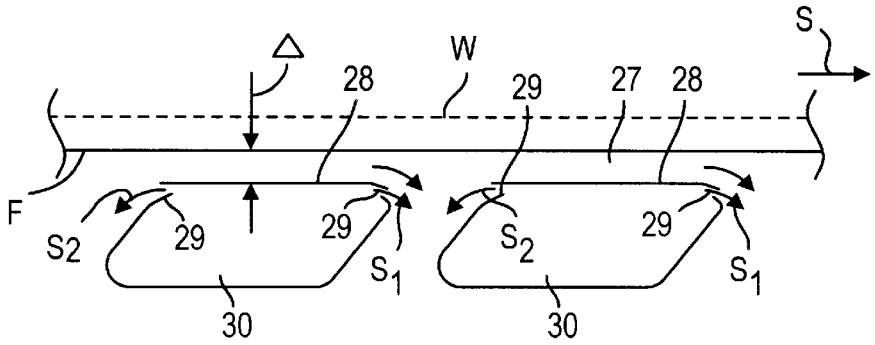
FIG. 2 is a schematic illustration of a group of two blow boxes for use in connection with the arrangement in accordance with the invention.

Referring to FIGS. 1 and 2 wherein like reference numerals refer to the same or similar elements, in the exemplifying embodiment shown in FIG. 1, a paper or material web W is dried by means of an impingement dryer 10, whose surrounding area is enclosed both above the paper web W and below a wire F on which the web W is carried by means of a box, hood or enclosure 20. From the impingement dryer 10, a blow medium which is generally and preferably superheated steam is blown toward the web W which runs on support of the wire F, the wire F supporting the web from below and the steam being blown toward the web from above in this illustrated embodiment. The enclosure 20 forms a closed space 21 which is open at inlet point A, at which the web W enters into the enclosed space 21, and at outlet point B, at which the web W departs from the closed space 21. The points A,B of passage of the web W are provided with support and sealing members 22A,22B.

In the space 21 in the interior of the enclosure 20, a number of vacuum blow devices 30 are arranged underneath the wire F (although this embodiment of the invention requires at least one such vacuum blow device or blow box, a plurality of such devices are shown). As described below, by means of the vacuum blow boxes 30, the run of the wire F and of the web W is stabilized, and thereby the runnability of the web W past the impingement dryer 10 and through the enclosure 20 is improved.

As shown in FIG. 2, steam and/or air jets or blowings $S_1$ are blown out of the blow boxes 30 placed at the side of wire F, i.e., on the side of the web on which the wire F is situated, in a direction substantially in the running direction of the wire F, and the speed of these jets $S_1$ is substantially higher than the speed of the wire F. As is well known, the moving wire F carries steam/air along with it. If the area from which the wire F takes steam/air along with it can be sealed, a vacuum is produced in this area. In the method and arrangement in accordance with the present invention, the sealing is carried out by means of blowings. Since the speed of the jets $S_1$ is higher than the speed of the wire F, an ejection effect is produced which enhances the vacuum produced by the pumping in the wire F. The sealing of the vacuum area in the other direction takes place by means of steam and/or air jets or blowings $S_2$.

By the effect of the vacuum in the area 27 formed between the upper surface or wall of the blow boxes 30 and the wire F, the steam/air in the region above the wire (either between the wire and the web or above the web) attempts to flow through the wire F. Since the web W is practically impenetrable by air, the web W adheres tightly onto the wire F, and no detrimental fluttering occurs. Thus, the blow boxes stabilize the run of the wire F and the web W in the area of the impingement dryer 10 in view of the creation of a vacuum on an opposite side of the wire from the impingement dryer.

In FIG. 1, there are three groups of blow boxes, each having two blow boxes 30 placed one after the other, and in the gaps between the groups, guide rolls 23 are placed. Depending on the geometry of the impingement dryer 10, there can be one or more blow boxes. The blow boxes have a substantially planar (flat) top face or wall 28 which is placed at a distance Δ from the drying wire F that runs facing the face 28. The distance Δ is preferably in the range of from about 5 mm to about 30 mm. At both ends of the planar wall 28 in the blow boxes 30, there are nozzle slots 29 by whose means the blowings $S_1$ and $S_2$ described above are produced (blowing $S_1$ being directed through the first nozzle slot 29 of the blow box in the running direction of the wire F and blowing $S_2$ being directed by the second nozzle slot 29 of the blow box in a direction opposite to the running direction of the wire F). The first nozzle slot is situated at a first end of the upper planar wall 28 and the second nozzle slot is situated at a second end of the upper planar wall 28 opposite the first end thereof. There may also be nozzles at the edges of the blow boxes 30, the access of steam/air between the box and the wire being sealed by means of blowings produced by means of the edge nozzles.

As shown in FIG. 1, several of the blow boxes 30 are situated partially or entirely in opposed relationship to the impingement dryer 10. However, there may also be blow boxes which are not in opposed relationship to the impingement dryer 10.

As shown in FIGS. 1 and 2, the steam needed by the blow boxes 30 is drawn into ducts 18 from the space 21 in the interior of the enclosure 20, preferably from the portion of the enclosure below the wire F in order that disturbing vertical flows should not arise inside the enclosure 20. From the ducts 18, the steam is passed along a duct 40 provided with regulation means such as a regulator 43 to a blower 41 which imparts movement to the steam or other materials removed from the interior of the enclosure 20. By means of the blower 41, at least a portion of the steam is passed along a blow line 42 into each blow device 30 through a respective duct 17. Ducts 17 each include regulation means such as a regulator 44 for regulating the blowing in the respective blow device 30. The blow line 42 can also include a heating device 45, for example a steam heat exchanger or a device for direct supply of steam, in which case a suitable temperature level can be maintained in the interior 21 of the enclosure 20 in order to eliminate any risk of condensation. By means of the blower 41, it is also possible to draw steam from the interior 21 of the enclosure 20 from the region above the wire F and the web along exhaust ducts 51 and feed pipe 52 and to feed at least a portion of this steam back to this region, after it has been optionally heated, along ducts 53,54. The duct 53 is provided with a regulation member 55 for regulating the quantity of the steam to be supplied to the interior 21 of the enclosure 20. The feed pipe 52 may also be provided with a regulation member 56. When the interior 21 of the enclosure has to be emptied of steam, for example, for servicing of the dryer unit, the enclosure 20 is emptied of steam by means of the blower 41, and similarly, during the start-up stage of the equipment, air can be removed through the blower 41 and the ducts 18,40 from the interior 21 of the enclosure 20.

Above, the invention has been described with reference to an exemplifying embodiment in which steam is used as the drying medium in the impingement dryer 10. The arrangement in accordance with the invention can also be applied, with the principles described above, in arrangements in which hot air or equivalent gaseous or liquid element is used as the drying medium in the impingement dryer unit 10 as well as for the blow medium for the blow boxes 30.

Figure 3:
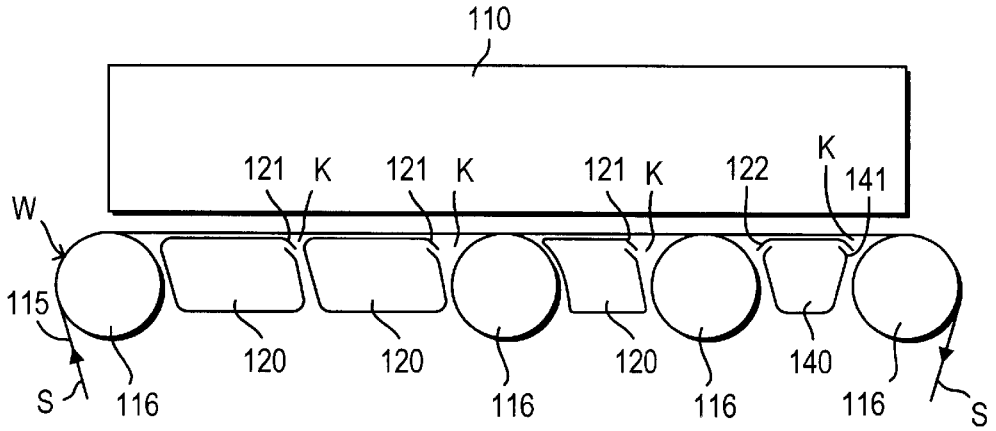
FIG. 3 is a schematic illustration of a planar dryer, in whose connection blow boxes in accordance with the invention are arranged.
Figure 4:
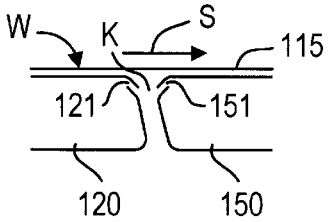
FIG. 4 is a schematic illustration of a further exemplifying embodiment of the invention.
Figure 5:
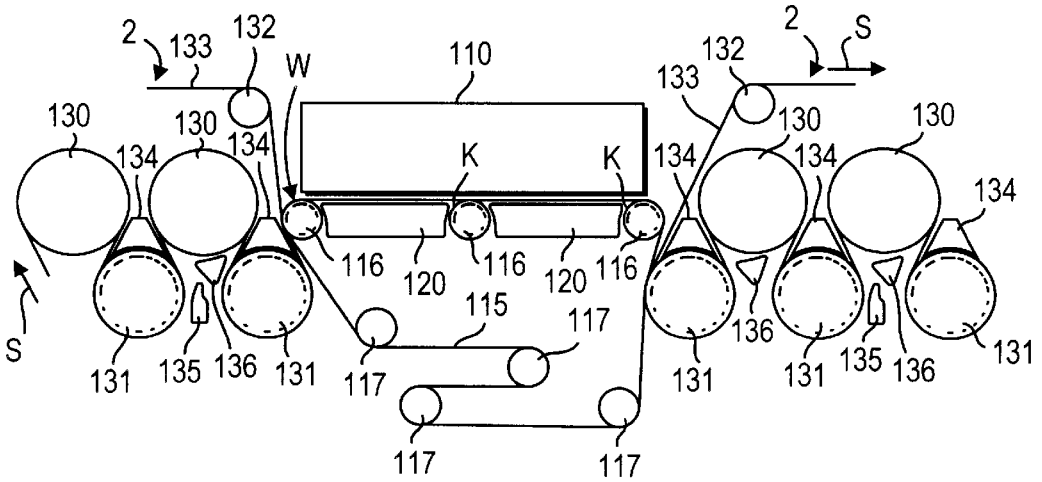
FIG. 5 is a schematic illustration of an exemplifying embodiment in which a planar dryer is arranged between groups of cylinders.

Referring now to FIGS. 3–5 wherein like reference numerals refer to the same or similar elements, in the exemplifying embodiment shown in FIG. 3, an impingement-drying/through-drying arrangement is shown and includes a planar impingement-drying/through-drying dryer 110, below which a wire 115 is guided. Wire 115 carries a paper web W and is guided in a planar and horizontal run while supported by rolls 116. The web W is also guided in a planar and horizontal draw while supported by the wire 115 in its run between rolls 116 and by a vacuum effect produced by the blow boxes 120, 140 arranged between rolls 116. The running direction of the paper web W is denoted by arrow S. The blow boxes 120 are provided with one or more nozzles or nozzle gaps 121, by whose means a blowing is directed to a gap K, i.e., in this embodiment of the invention, as viewed in the running direction of the web, from an outlet edge of the blow box 120 in order to preferably produce a vacuum effect below the wire 115 so as to support the running of the web W and the wire 115. The blowing is at least effective to reduce the pressure below the wire in order to pull the web downward and maintain its adherence to the wire 115. The gap K is formed alongside and/or at an edge of the bow boxes 120. The blow boxes 120 also comprise lateral nozzles (not shown) so as to produce lateral sealing. As shown in FIG. 3, there are several blow boxes 120 arranged between the rolls 116 (although only a single blow box may be used), and in connection with the rolls it is also possible to use a blow box 140, in which, in addition to a blowing 141 at the pressure/outlet side, a blowing is also blown at the vacuum/inlet side 142 (see the description above with reference to FIGS. 1 and 2).

In accordance with another embodiment of the invention, when two blow boxes are arranged side by side, their blowings can also be arranged one opposite the other (as shown in FIG. 4), so that they are arranged at the outlet or rear edge of the first box 120, as viewed in the running direction S of the web, i.e., in the gap K. In such a case, the blow nozzles 121, 151 of the blow boxes 120, 150 are placed at opposite edges of the boxes and are operative for the same gap. Between the blow box 150 and the roll 116, there may be a mechanical seal made of a resilient material, or the blow box 150 may be provided with a blowing at the outlet side, as is the case at the blow box 140.

FIG. 5 shows a device in accordance with the invention arranged in connection with a planar impingement-drying/through-drying unit 110 so that one blow box 120 is arranged between each pair of adjacent rolls 116. The web W runs on support of the wire 115, which wire is guided by, besides by the rolls 116, also by guide/alignment rolls 117. The impingement drying unit 110 is arranged between two groups R of cylinders, in which groups the web W runs meandering from heated drying cylinders 130 onto reversing rolls 131 on support of a drying wire 133, which is guided by guide/alignment rolls 132. The running direction of the web is denoted by reference arrow S, and further, runnability and pocket ventilation devices 134, 135 and doctors 136 are shown.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims. For example, a blow jet or blowings as used herein may constitute either a single flow along substantially the entire width of the web or a plurality of flows which combine to extend along substantially the entire width of the web.

I claim:

1. In an arrangement for impingement drying and/or through-drying of a paper or material web including an impingement drying and/or through-drying dryer and a wire for supporting the web in a run over the dryer, a blow medium being directed from the dryer toward the web to dry the web, the improvement comprising:

at least one blow box arranged in opposed relationship to the dryer for maintaining the web on the wire, said at least one blow box being structured and arranged to direct first and second blowings of a blow medium substantially across the entire width of the web, said first and second blowings being directed in a substantially parallel direction relative to said wire, the blow medium of said first and second blowings being substantially the same as the blow medium of the dryer.

2. The arrangement of claim 1, wherein the blow medium of said at least one blow box and the dryer is superheated steam, further comprising an enclosure surrounding the dryer and said at least one blow box, said enclosure having an inlet point at which the web and wire are passed into an interior of said enclosure and an outlet point at which the web and wire are passed out of said enclosure.

3. The arrangement of claim 2, further comprising a blower for imparting movement to a medium, first ducts for connecting said blower to said at least one blow box, first regulation means arranged in connection with said first ducts for regulating flows of steam and/or air from said blower through said first ducts to said at least one blow box, exhaust pipes arranged in said enclosure and through which steam and/or air is drawn from the interior of said enclosure at at least one location on a side of the wire on which said at least one blow box is arranged, second ducts for connecting said exhaust pipes to said blower, and second regulation means arranged in connection with said second ducts for regulating flows of steam and/or air from the interior of said enclosure through said second ducts and exhaust pipes to said blower.

4. The arrangement of claim 3, further comprising additional exhaust pipes arranged in said enclosure through which steam and/or air is drawn from the interior of said enclosure at locations on a side of the wire on which the dryer is arranged, an exhaust duct for coupling said exhaust pipes to said blower, third regulation means arranged in connection with said exhaust duct for regulating a flow of steam and/or air from the interior of said enclosure through said exhaust duct and additional exhaust pipes to said blower, feed pipes for delivering steam to said enclosure at the side of the wire on which the dryer is arranged, and a feed duct for coupling said feed pipes to said blower and through which steam and/or air from said blower is passed to said feed pipes.

5. The arrangement of claim 3, further comprising heating means arranged after said blower in a flow direction of the steam and/or air to heat the steam and/or air.

6. The arrangement of claim 1, wherein said at least one blow box comprises first and second nozzle slots, said first blowings being directed from said first nozzle slot and said second blowings being directed from said second nozzle slot.

7. The arrangement of claim 6, wherein said at least one blow box includes an upper wall extending in the running direction of the wire and having first and second opposed ends, said first nozzle slot being situated at said first end of said upper wall and said second nozzle slot being situated at said second end of said upper wall opposite said first end of said upper wall.

8. In an arrangement for impingement drying and/or through-drying of a paper or material web including an impingement drying and/or through-drying dryer and a wire for supporting the web in a substantially planar run past the dryer, a blow medium being directed from the dryer toward the web to dry the web, the improvement comprising:

at least one blow box arranged in opposed relationship to the dryer, a gap being formed alongside at least one edge of said at least one blow box, each of said at least one blow box comprising at least one blow nozzle through which a medium is directed to reduce the pressure in said gap and thereby maintain the web on the wire, said at least blow nozzle being adapted for directing said medium in a substantially parallel direction relative to said wire.

9. The arrangement of claim 8, wherein said at least one blow nozzle comprises a plurality of blow nozzles.

10. The arrangement of claim 8, wherein said at least one blow nozzle is arranged at a rear edge of said at least one blow box in a running direction of the wire.

11. The arrangement of claim 8, wherein each of said at least one blow box further comprises lateral nozzles for directing blowings to seal lateral areas of a space between said blow box and the wire.

12. The arrangement of claim 8, wherein said at least one blow box comprises first and second blow boxes arranged alongside one another, said at least one blow nozzle of said first blow box being arranged at a rear edge of said first blow box in the running direction of the wire and said at least one blow nozzle of said second blow box being arranged at a front edge of said second blow box in the running direction of the wire such that said at least one blow nozzle of said first blow box and said at least one blow nozzle of said second blow box direct medium to reduce the pressure in the same gap.

13. The arrangement of claim 8, wherein said at least one blow box comprises first and second blow boxes, said at least one blow nozzle of said first blow box being arranged at a rear edge of said first blow box in the running direction of the wire and said at least one blow nozzle of said second blow box being arranged at a rear edge of said second blow box in the running direction of the wire.

14. The arrangement of claim 8, further comprising rolls for guiding the wire in the substantially planar run past the dryer.

15. The arrangement of claim 14, wherein said rolls are arranged such that the wire has a substantially planar run between two of said rolls which extends along substantially an entire length of the dryer in a running direction of the wire.

16. The arrangement of claim 8, wherein the dryer is arranged above said at least one blow box.

17. The arrangement of claim 8, further comprising at least one additional blow box structured and arranged to direct first and second blowings of a blow medium substantially across the entire width of the web.

18. The arrangement of claim 17, wherein each of said at least one additional blow box comprises first and second nozzle slots, said first blowings being directed from said first nozzle slot and said second blowings being directed from said second nozzle slot.

19. The arrangement of claim 18, wherein each of said at least one additional blow box includes an upper wall extending in the running direction of the wire and having first and second opposed ends, said first nozzle slot being situated at said first end of said upper wall and said second nozzle slot being situated at said second end of said upper wall opposite said first end of said upper wall.

20. The arrangement of claim 8, wherein the dryer is arranged between a pair of drying groups in a dryer section of a paper machine.

21. The arrangement of claim 1, wherein said first blowing is directed in a running direction of the web and said second blowing is directed in a direction opposite to the running direction of the web.

22. The arrangement of claim 8, wherein said at least one blow nozzle comprises first and second blow nozzles for directing said medium in a substantially parallel direction relative to the wire.

23. The arrangement of claim 22, wherein said first blow nozzle is adapted for directing said medium in a running direction of said web and said second blow nozzle is adapted for directing said medium in a direction opposite to the running direction of the web.

* * * * *